US009053694B2

(12) United States Patent
Kanayama et al.

(10) Patent No.: US 9,053,694 B2
(45) Date of Patent: Jun. 9, 2015

(54) ELECTRONIC PERCUSSION INSTRUMENT

(71) Applicant: YAMAHA CORPORATION, Hamamatsu-shi, Shizuoka-ken (JP)

(72) Inventors: Emi Kanayama, Hamamatsu (JP); Masao Sato, Hamamatsu (JP)

(73) Assignee: YAMAHA CORPORATION (JP)

( * ) Notice: Subject to any disclaimer, the term of this patent is extended or adjusted under 35 U.S.C. 154(b) by 0 days.

(21) Appl. No.: 14/204,359

(22) Filed: Mar. 11, 2014

(65) Prior Publication Data

US 2014/0260919 A1 Sep. 18, 2014

(30) Foreign Application Priority Data

Mar. 12, 2013 (JP) ..... 2013-049037
Mar. 11, 2014 (JP) ..... 2014-047223

(51) Int. Cl.

| | |
|---|---|
| ***G10H 1/32*** | (2006.01) |
| ***G10H 3/00*** | (2006.01) |
| ***G10H 3/14*** | (2006.01) |
| ***G10D 13/02*** | (2006.01) |

(52) U.S. Cl.
CPC ..... *G10H 3/146* (2013.01); *G10D 13/024* (2013.01)

(58) Field of Classification Search
CPC ..... G10D 13/026; G10H 2230/275; G10H 2230/291
USPC ..... 84/421, 743
See application file for complete search history.

(56) References Cited

U.S. PATENT DOCUMENTS

| | | | | |
|---|---|---|---|---|
| 3,250,169 | A | 5/1966 | Stone, Jr. et al. | |
| 4,606,525 | A * | 8/1986 | Lombardi | 248/460 |
| 4,669,349 | A | 6/1987 | Hyakutake | |
| 4,800,795 | A * | 1/1989 | Yamashita | 84/421 |

(Continued)

FOREIGN PATENT DOCUMENTS

| | | | |
|---|---|---|---|
| EP | 1837860 | A2 | 9/2007 |
| JP | 2009128426 | A | 6/2009 |

OTHER PUBLICATIONS

U.S. Office Action for related U.S. Appl. No. 14/204,411, mail date Jun. 20, 2014.

(Continued)

*Primary Examiner* — Jeffrey Donels
(74) *Attorney, Agent, or Firm* — Rossi, Kimms & McDowell LLP

(57) ABSTRACT

An electronic percussion instrument includes a stand, a support member (e.g. a stay), a pad member with a head, and an impact sensor. The support member has an L-shape including a stand-attaching portion and a pad-attaching portion. The stand-attaching portion is fixed to the stand while the pad-attaching portion is extended vertically from the front end of the stand-attaching portion at an inflection point. Owing to the elasticity of the support member, the pad-attaching portion is deflected about the inflection point in the rearward direction in comparison with the stand-attaching portion due to a striking force applied to the head being struck with a beater. Upon detecting an impact applied to the head, the impact sensor generates an electric signal so as to generate a musical sound. Thus, it is possible to suppress floor reverberation by absorbing an impact between the head and the beater via the support member.

17 Claims, 11 Drawing Sheets

(56) References Cited

U.S. PATENT DOCUMENTS

| | | | | |
|---|---|---|---|---|
| 5,182,416 | A * | 1/1993 | Schweizer | 84/723 |
| 5,337,646 | A * | 8/1994 | Austin | 84/421 |
| 5,583,307 | A | 12/1996 | Tobia, Jr. | |
| 5,585,581 | A | 12/1996 | Rogers | |
| 5,864,077 | A | 1/1999 | Gatzen | |
| 5,949,008 | A * | 9/1999 | Augsburger | 84/421 |
| 6,215,053 | B1 | 4/2001 | Adinolfi | |
| 6,525,249 | B1 | 2/2003 | Suenaga | |
| 6,580,023 | B2 | 6/2003 | Belli | |
| 6,653,540 | B2 * | 11/2003 | Izen et al. | 84/421 |
| 6,686,526 | B2 | 2/2004 | Ezbicki | |
| 6,815,602 | B2 * | 11/2004 | De Franco | 84/730 |
| 6,828,494 | B2 | 12/2004 | Toda | |
| 6,921,857 | B2 | 7/2005 | Yoshino et al. | |
| 6,927,330 | B2 | 8/2005 | May | |
| 6,949,701 | B2 | 9/2005 | Okumura | |
| 7,135,630 | B2 | 11/2006 | Maruhashi et al. | |
| 7,214,867 | B1 | 5/2007 | Gatzen et al. | |
| 7,256,342 | B2 | 8/2007 | Hagiwara et al. | |
| 7,439,432 | B2 | 10/2008 | Hiraku | |
| 7,488,887 | B2 | 2/2009 | Mori | |
| 7,642,439 | B2 | 1/2010 | Fujii | |
| 7,723,596 | B2 | 5/2010 | Kelly | |
| 7,928,304 | B2 * | 4/2011 | Eason et al. | 84/421 |
| 8,039,724 | B1 | 10/2011 | Norman et al. | |
| 8,263,850 | B2 * | 9/2012 | Hashimoto et al. | 84/723 |
| 8,283,543 | B2 | 10/2012 | McBain | |
| 8,294,013 | B2 | 10/2012 | Lento | |
| 8,431,813 | B2 * | 4/2013 | Mori | 84/723 |
| 8,536,435 | B2 * | 9/2013 | Mori | 84/421 |
| 8,563,843 | B1 | 10/2013 | Shemesh | |
| 2003/0029301 | A1 | 2/2003 | Belli | |
| 2003/0037660 | A1 | 2/2003 | Suenaga | |
| 2003/0070533 | A1 | 4/2003 | Ezbicki | |
| 2003/0136244 | A1 | 7/2003 | Okumura | |
| 2003/0188624 | A1 | 10/2003 | Toda | |
| 2003/0188629 | A1 * | 10/2003 | Suenaga | 84/723 |
| 2004/0118269 | A1 | 6/2004 | Yoshino | |
| 2004/0159223 | A1 | 8/2004 | Kiyono et al. | |
| 2004/0211310 | A1 | 10/2004 | Hagiwara et al. | |
| 2004/0261603 | A1 | 12/2004 | May | |
| 2006/0230912 | A1 | 10/2006 | Pickens | |
| 2007/0051231 | A1 | 3/2007 | Fujii | |
| 2007/0137460 | A1 | 6/2007 | Mori | |
| 2007/0169610 | A1 | 7/2007 | Pickens | |
| 2007/0295189 | A1 | 12/2007 | Kelly | |
| 2008/0229902 | A1 * | 9/2008 | Mori et al. | 84/421 |
| 2009/0000464 | A1 | 1/2009 | Mishima | |
| 2009/0019985 | A1 | 1/2009 | Casanta | |
| 2009/0229450 | A1 | 9/2009 | Hashimoto | |
| 2009/0241755 | A1 | 10/2009 | Yoshino et al. | |
| 2010/0175535 | A1 | 7/2010 | Lento | |
| 2010/0282047 | A1 * | 11/2010 | Hashimoto et al. | 84/723 |
| 2010/0307323 | A1 | 12/2010 | Mori | |
| 2011/0030529 | A1 | 2/2011 | Chen | |
| 2011/0138988 | A1 | 6/2011 | Lento | |
| 2011/0219938 | A1 | 9/2011 | McBain | |
| 2012/0174732 | A1 | 7/2012 | Martinazzi | |
| 2012/0266737 | A1 | 10/2012 | Mori | |
| 2013/0098227 | A1 | 4/2013 | Wei | |
| 2013/0112068 | A1 | 5/2013 | Rogers | |
| 2013/0152768 | A1 * | 6/2013 | Rapp | 84/634 |
| 2013/0340596 | A1 | 12/2013 | Yao | |
| 2014/0020548 | A1 | 1/2014 | Shemesh | |
| 2014/0026733 | A1 | 1/2014 | Hashimoto | |
| 2014/0060284 | A1 | 3/2014 | Yoshino | |
| 2014/0069256 | A1 | 3/2014 | Hashimoto | |
| 2014/0069265 | A1 | 3/2014 | Shih et al. | |
| 2014/0116229 | A1 * | 5/2014 | Mori | 84/415 |
| 2014/0208926 | A1 | 7/2014 | Shepherd | |
| 2014/0216234 | A1 | 8/2014 | Wei | |
| 2015/0027301 | A1 | 1/2015 | Shih et al. | |

OTHER PUBLICATIONS

Related U.S. Appl. No. 14/204,247, filed Mar. 11, 2014.
Related U.S. Appl. No. 14/204,411, filed Mar. 11, 2014.
Related U.S. Appl. No. 14/204,180, filed Mar. 11, 2014.
Related U.S. Appl. No. 14/204,563, filed Mar. 11, 2014.
Office Action issued in U.S. Appl. No. 14/204,180, mailed Jan. 15, 2015.
Notice of Allowance issued in U.S. Appl. No. 14/204,411, mailed Nov. 21, 2014.
Non-Final Office Action issued in related U.S. Appl. No. 14/204,563, dated Apr. 14, 2015.

* cited by examiner

FREQUENCY CHARACTERISTICS OF IMPULSIVE SOUNDS

ELECTRONIC PERCUSSION INSTRUMENT

BACKGROUND OF THE INVENTION

1. Field of the Invention

The present invention relates to an electronic percussion instrument including an impact sensor which converts vibration of a head being struck with a beater into an electric signal so as to generate an electronic musical sound.

The present application claims priority on Japanese Patent Application No. 2013-49037 and Japanese Patent Application No. 2014-47223, the entire content of which is incorporated herein by reference.

2. Description of the Related Art

Conventionally-known electronic percussion instruments are designed to generate an electronic musical sound based on an electric signal output from an impact sensor which detects vibration of a head being struck with a beater. Patent Literature Document 1 (PLT1) discloses an electronic percussion instrument serving as an electronic bass drum with a circular head, made of an elastic material, whose periphery is engaged with a frame. An impact sensor is attached to the back of a strike area corresponding to the center of a head via a center cushion with an outer periphery encompassed by a ring-shaped damper cushion.

A drum body is supported by a stand (i.e. a riser and legs) which is placed on the floor. The head of a drum body is supported by a cylindrically-shaped shell via a rim cover and fixed to a ring-shaped frame and a circular frame relative to a shell.

In the foregoing electronic percussion instrument, a drum body including a head is firmly fixed to a stand, wherein the periphery of a head is fixed in position in a drum body. For this reason, when a head is being struck with a beater, an intense impact is directly transmitted to the floor, thus causing a large sound on the floor (which will be referred to as "floor reverberation"). A floor-reverberation sound is generated together with an electronic musical sound which is electronically generated based on an electric signal of an impact sensor detecting an impact applied to the head of an electronic percussion instrument, thus degrading sound quality in terms of articulation. Additionally, a large force may be instantaneously and repeatedly applied to constituent elements other than the head of a drum body, thus degrading the durability of an electronic percussion instrument.

CITATION LIST

Patent Literature Document

Patent Literature Document 1: Japanese Patent Application Publication No. 2009-128426

SUMMARY OF THE INVENTION

It is an object of the present invention to provide an electronic percussion instrument which is designed to suppress floor reverberation by absorbing a striking impact via a warp or deflection of a pad-attaching portion in a head, thus improving sound quality such as articulation while improving the durability of an electronic percussion instrument.

The present invention is directed to an electronic percussion instrument which generates an electronic musical sound in response to a striking operation applied to a head with a beater.

An electronic percussion instrument includes a stand, a support member, a pad member, and an impact sensor. The stand is placed on the floor. The support member includes a stand-attaching portion which is fixed to the floor and a pad-attaching portion which is extended vertically from the stand-attaching portion at an inflection point. The stand-attaching portion and the pad-attaching portion are unified together to form a bent shape in a side view. The pad member includes a head which is struck with a beater. The pad member is attached to the pad-attaching portion. The impact sensor converts a vibration occurring on the head subjected to a striking operation into an electric signal. In particular, the support member is formed such that the pad-attaching portion is deflected about the inflection point in the rearward direction relative to the stand-attaching portion due to a striking operation which is applied to the head. In the support member, the inflection point is positioned at the front end of the stand-attaching portion.

In the above, it is possible to introduce a rear panel which is used to arrange at least one interface and which is fixed to either an upper portion or a lower portion in a rear side of the pad-attaching portion. Additionally, it is possible to introduce a front cover which is used to cover the external circumference of the pad member and which is attached to the rear panel without contacting the pad member. In this connection, the support member is integrally formed using a metal.

As described above, the present invention is designed to suppress floor reverberation by absorbing a striking impact applied to the head of an electronic percussion instrument via a warp or deflection of a pad-attaching portion in a head, thus demonstrating advantageous effects. That is, it is possible to improve sound quality such as articulation while improving durability of an electronic percussion instrument. Specifically, it is possible to setting a deflecting point of a pad-attaching portion in a head in a front side as possible, thus preventing a stand from being risen above the floor while improving durability of an electronic percussion instrument. It is possible to reinforce a pad-attaching portion in a head while improving durability without increasing the number of parts in an electronic percussion instrument. It is possible to reliably cover a pad member while suppressing sound-box reverberation, thus securing sufficient sound quality while attenuating noise. It is possible to improve the manufacturability and the durability of an electronic percussion instrument.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENT

The present invention will be described in further detail by way of examples with reference to the accompanying drawings.

Figure 1A:
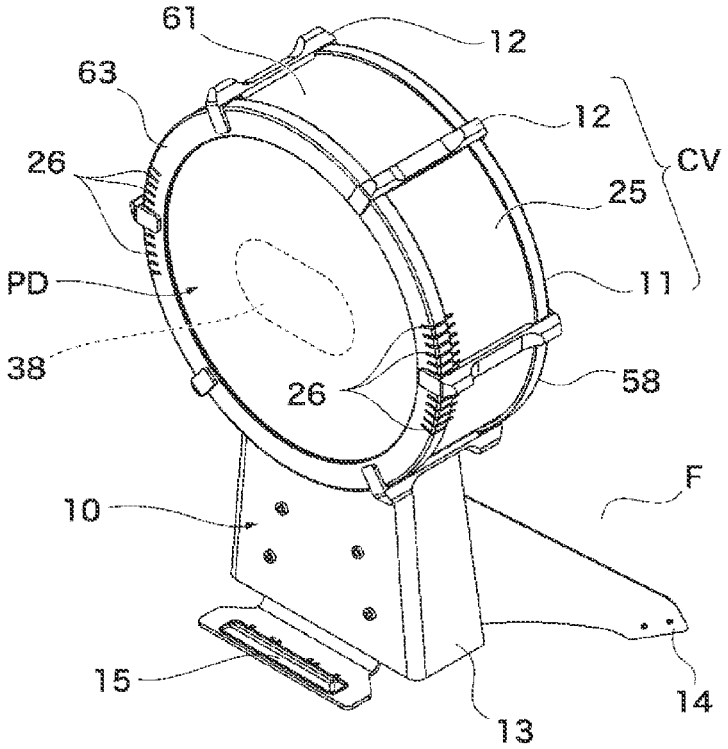
FIG. 1A is a perspective view showing the front side of an electronic percussion instrument according to the preferred embodiment of the present invention.
Figure 1B:
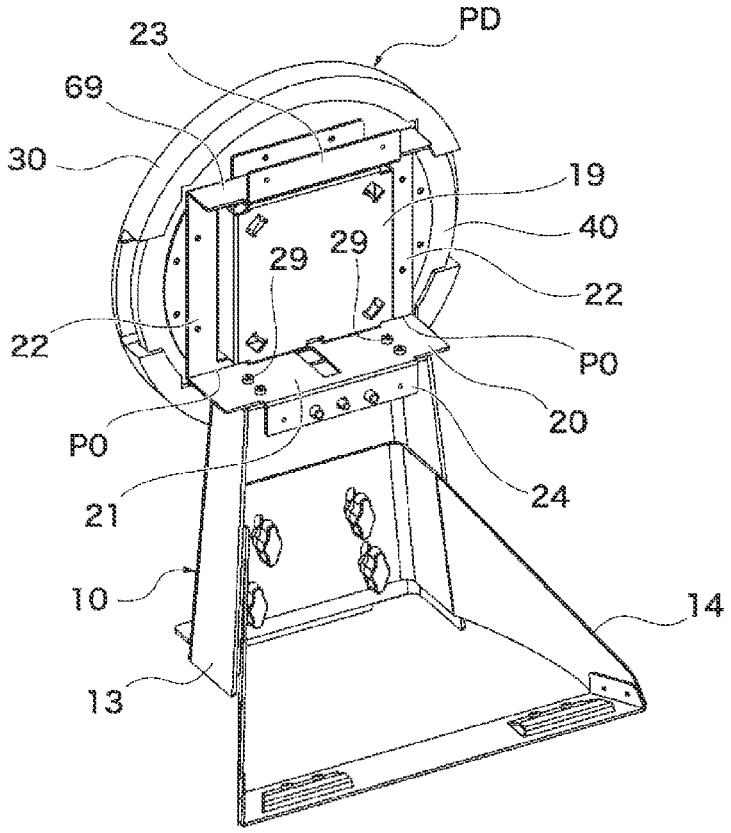
FIG. 1B is a perspective view showing the rear side of the electronic percussion instrument.
Figure 2B:
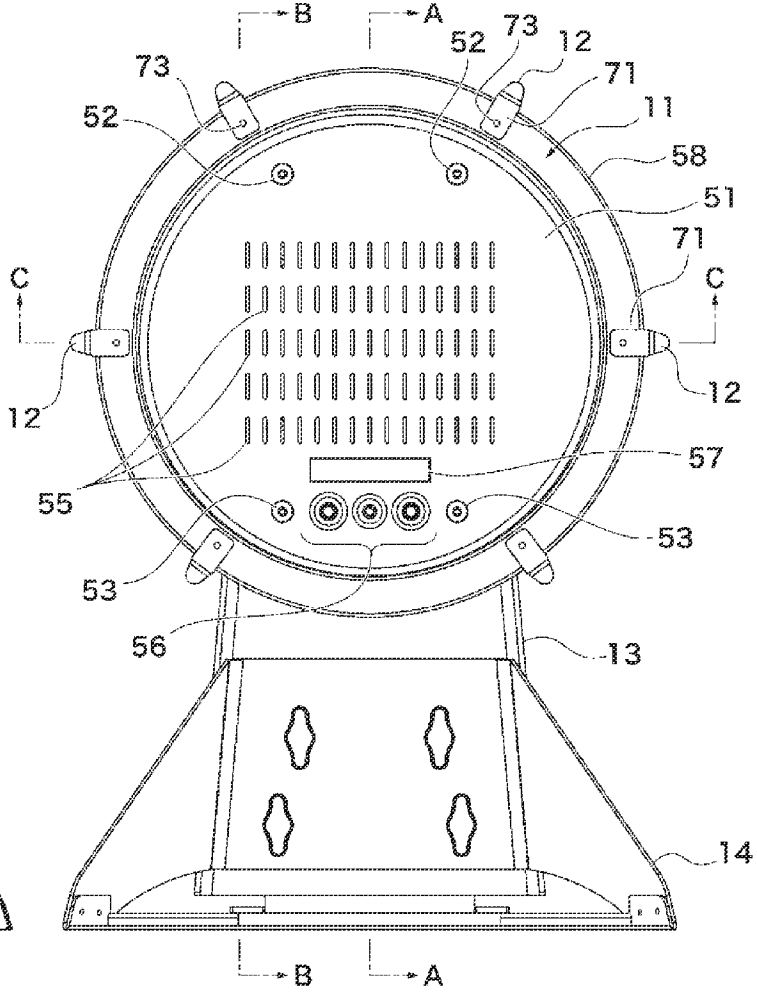
FIG. 2B is a rear view of the electronic percussion instrument.
Figure 2A:
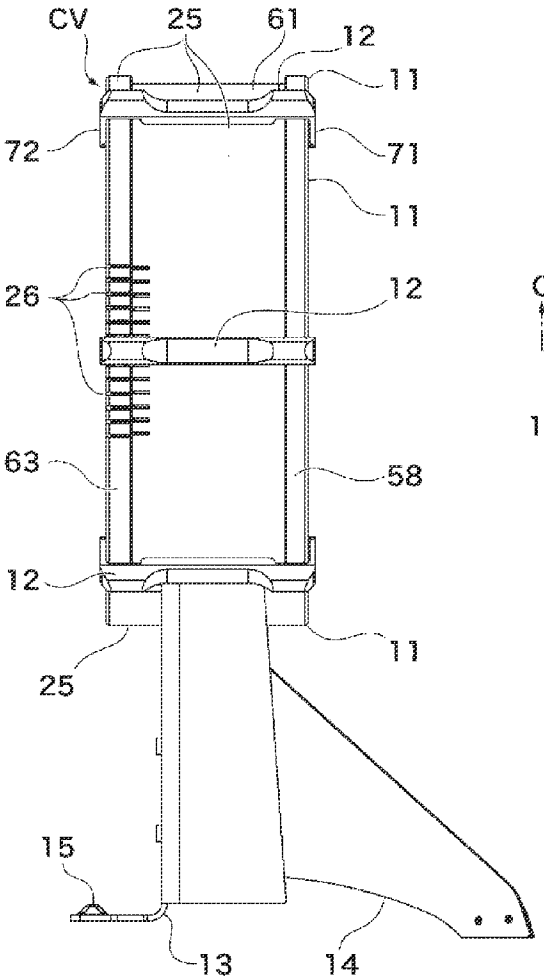
FIG. 2A is a side view of the electronic percussion instrument.

FIG. 1A is a perspective view showing the front side of an electronic percussion instrument according to the preferred embodiment of the present invention, while FIG. 1B is a perspective view showing the rear side of the electronic percussion instrument precluding covers. FIG. 2A is a side view of the electronic percussion instrument, while FIG. 2B is a rear view of the electronic percussion instrument.

The electronic percussion instrument of the present embodiment serves as an electronic bass drum in which a main body serving as a kick pad is supported by a stand 10. The stand 10 including a front leg 13 and a rear leg 14 is placed on a floor F. A pedal-attaching portion 15 is formed in connection with the front leg 13 of the stand 10. A foot pedal device (not shown) is additionally attached to the front side of the electronic percussion instrument in proximity to a player (e.g. a drummer) who plays the electronic percussion instrument. For convenience sake, four directions (i.e. UP, DOWN, RIGHT, LEFT) are determined in the player's view, i.e. in the front view of the electronic percussion instrument shown in FIG. 2A. Additionally, two directions (i.e. FRONT, REAR) are determined in the player's view, and therefore the front side matches the player's side.

It is possible to employ the generally-manufactured product of a foot pedal device, in which a player may operate (or depress) a pedal with his/her foot to strike a circular-shaped pad member PD with a beater (not shown). In this connection, the foot pedal device may include a single beater. The present embodiment is adapted to a twin-beater foot pedal device including two beaters which can be independently operated by a player. For this reason, the circular-shaped pad member PD includes an elliptically-shaped main strike area 38 which can be divided into left and right sides about the center point in the front view in connection with two beaters. That is, the foot pedal device is arranged such that the left and right beaters can strike the left and right sides of the main strike area 38 respectively.

As shown in FIG. 1B, a stay 20 is fixed to the upper side of the stand 10. The pad member PD is fixed to the front side of the stay 20 via a flange of a cushion-holding member 19.

Figure 3:
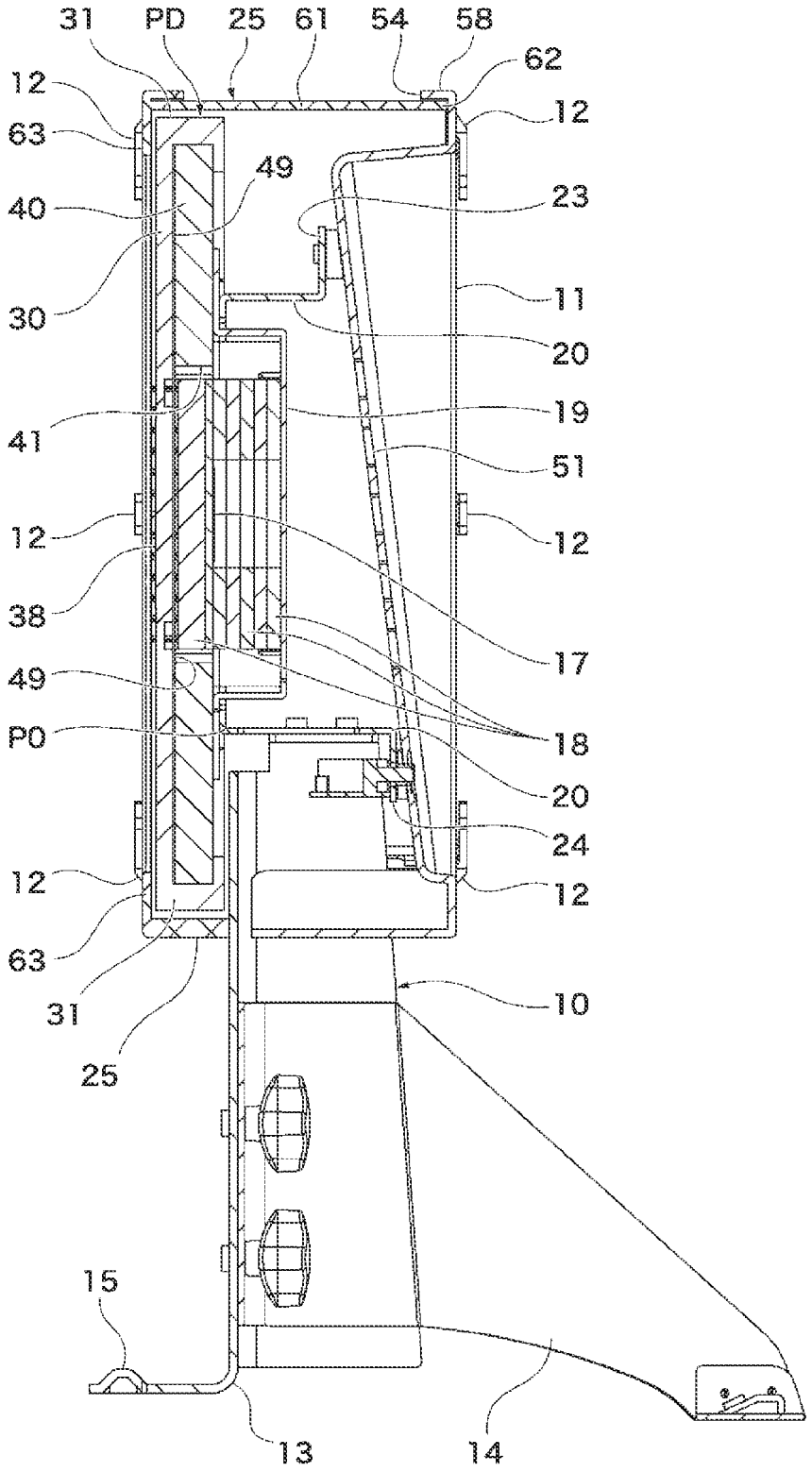
FIG. 3 is a longitudinal sectional view taken along line A-A in FIG. 2B.
Figure 4:
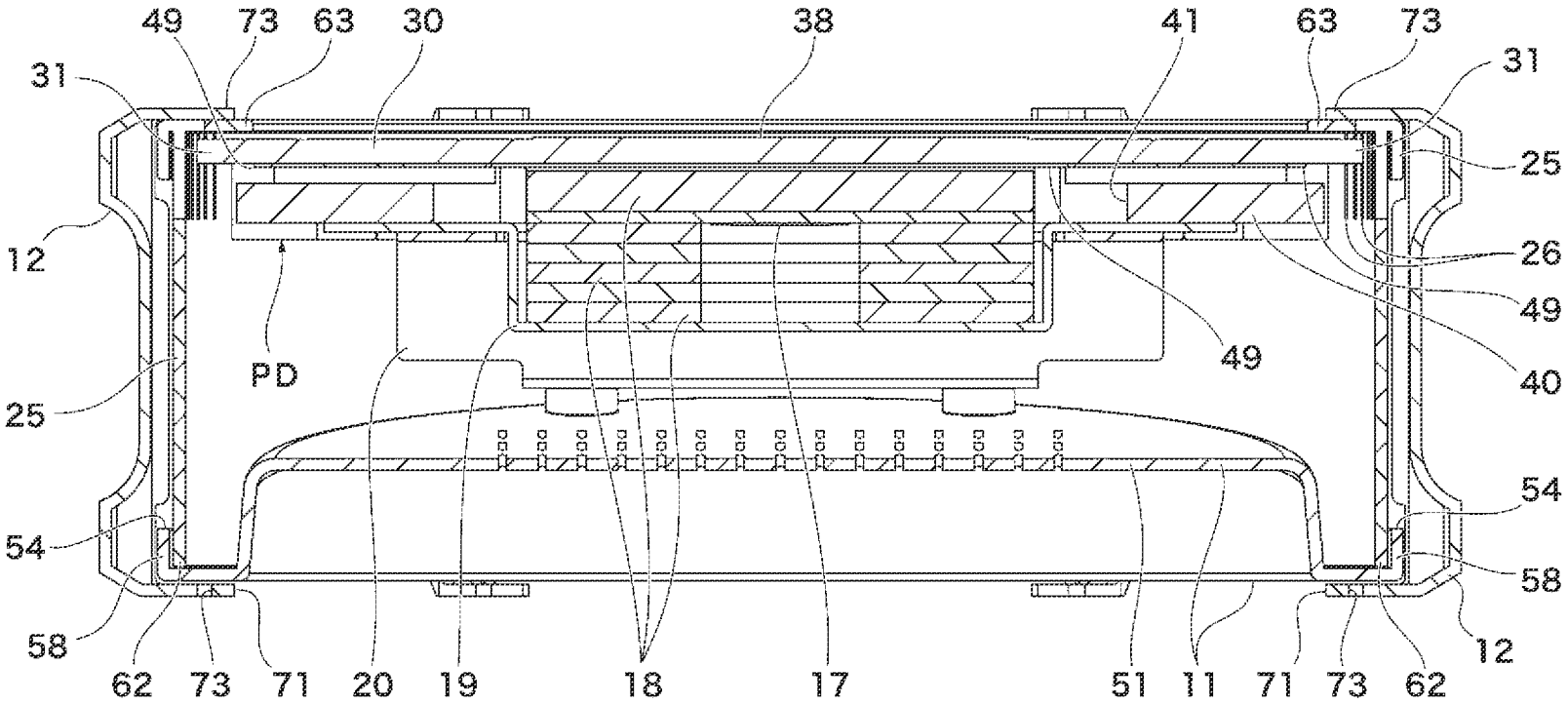
FIG. 4 is a cross-sectional view taken along line C-C in FIG. 2B.
Figure 5:
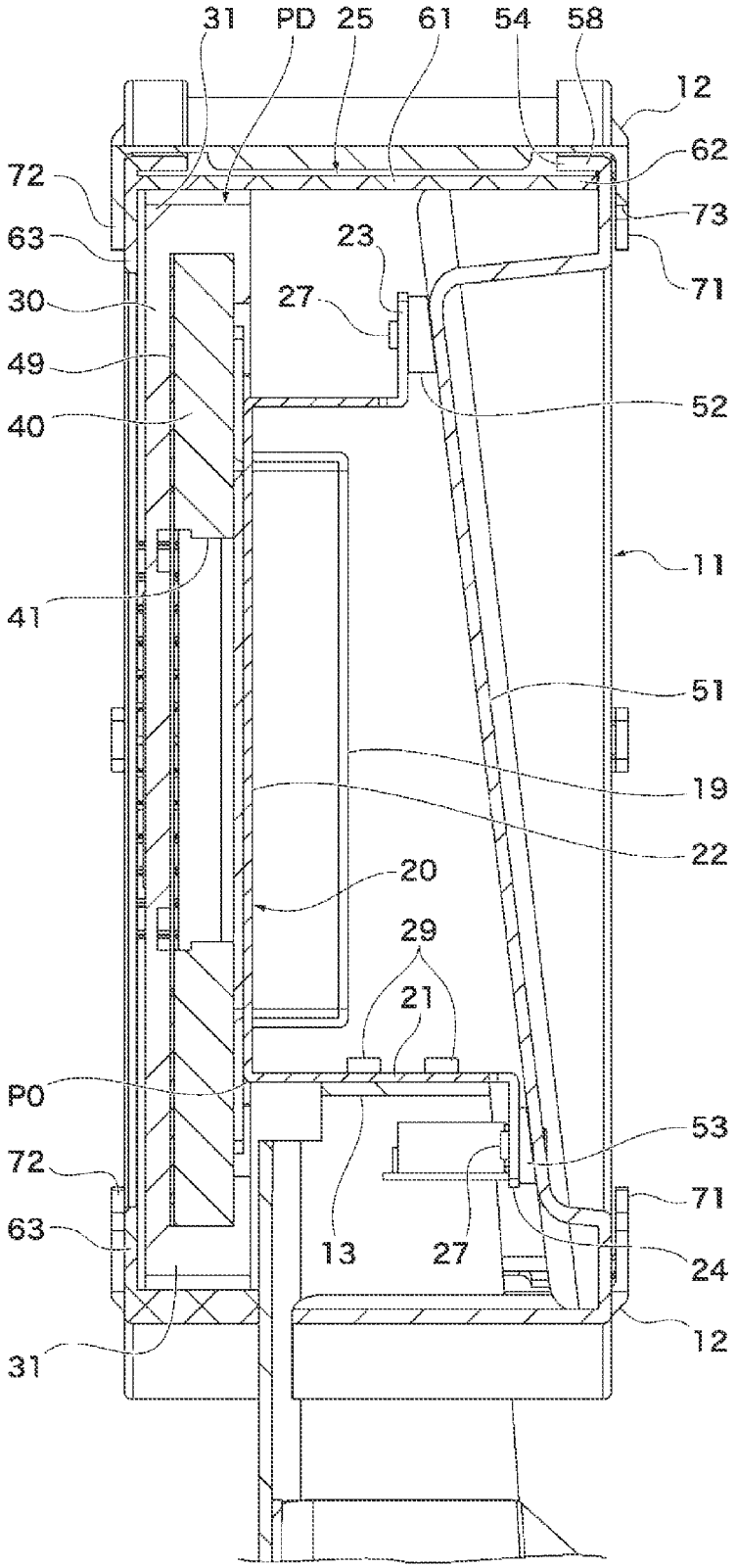
FIG. 5 is a longitudinal sectional view taken along line B-B in FIG. 2B.

FIG. 3 is a longitudinal sectional view of the electronic percussion instrument along line A-A in FIG. 2B; FIG. 4 is a cross-sectional view of the electronic percussion instrument along line C-C in FIG. 2B; FIG. 5 is a longitudinal sectional view of the electronic percussion instrument along line B-B in FIG. 2B.

The pad member PD includes a head 30 which is integrally formed using an elastic material such as rubber, silicon, and urethane, a frame 40 made of a resin, and a plate 49 made of a hard resin or a metal. The head 30 is made of an elastic material which is softer or more elastic than the material of the frame 40. The plate 49 is made of a material which is harder than the material of the head 30, wherein the plate 49 is a plate member serving as a vibration damper.

The plate 49 is adhered to the rear side of the head 30 having a periphery 31. The head 30 is attached to the frame 40 such that the periphery of the frame 40 is externally covered with the upper and lower sides of the periphery 31 of the head 30.

As shown in FIG. 1A, the main strike area 30 of the head 30 is an elongated elliptical shape since the present embodiment adopts a twin-beater foot pedal device. A protective material having flexibility such as a knitted material is attached to the surface of the head 30. For convenience sake, the strike face of the head 30 is described such that the surface of the head 30 will not be differentiated from the surface of a knitted material as necessary.

As shown in FIG. 1A, a cover member CV is formed using a front cover 25 and a rear cover 11, which are interconnected together via six hooks 12. These constituent elements are each made of an elastic material such as a resin. In this connection, the cover member CV is not necessarily essential to generate an electronic musical sound based on an impact on the head 30 with a beater. The cover member CV serves as a protective member which is used to cover the pad member PD. Owing to the cover member CV, the electronic percussion instrument may be visually observed as an acoustic bass drum set. Additionally, it is possible to demonstrate an external design effect with the cover member CV which can be freely designed.

Figure 6:
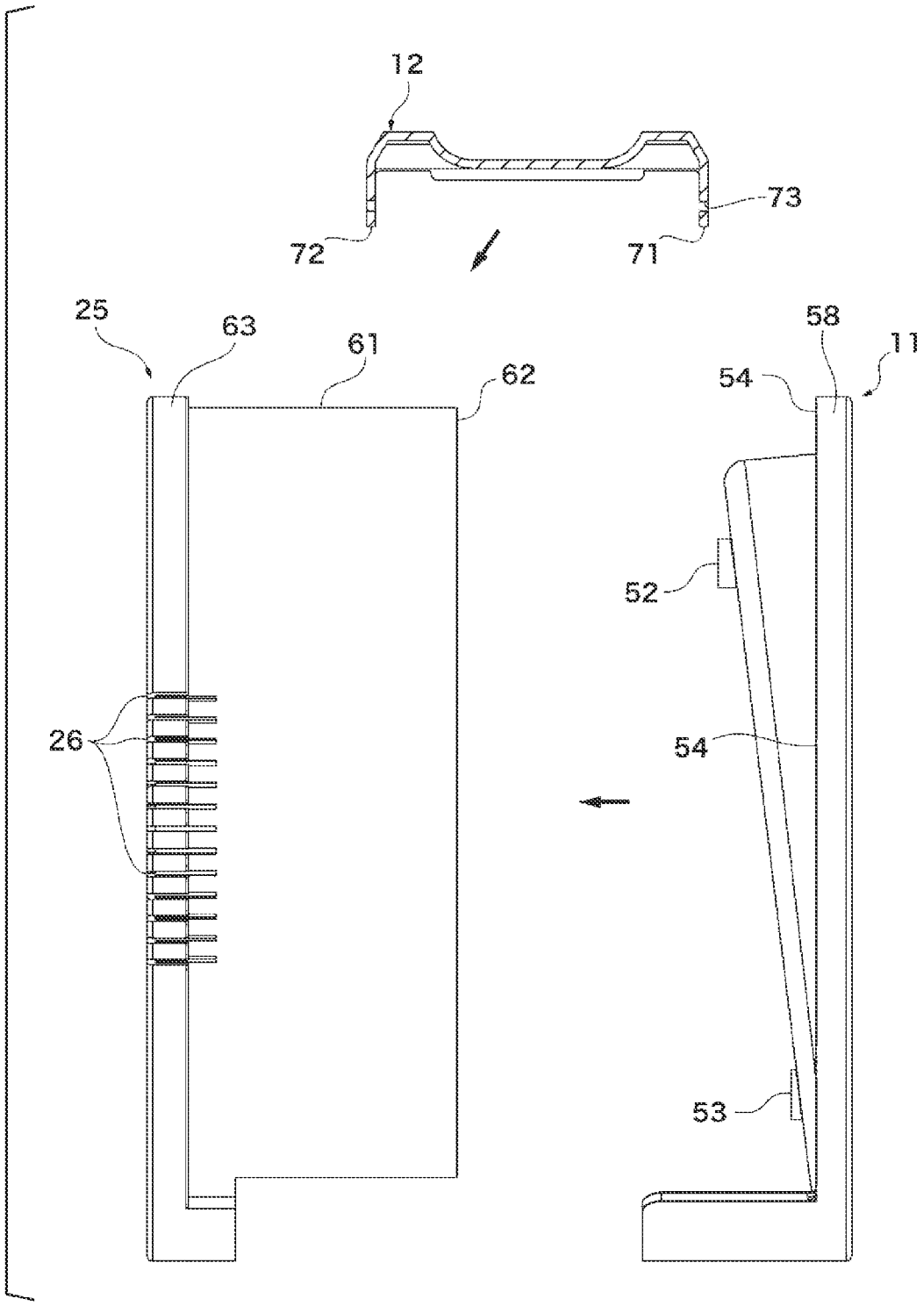
FIG. 6 is an exploded view of a cover in the electronic percussion instrument.

FIG. 6 is an exploded view of the cover member CV. The front cover 25 includes a cylindrical portion 61 and a ring-shaped portion 63. The ring-shaped portion 63 is attached to the front side of the cylindrical portion 61. The cylindrical portion 61 may not have an entirely cylindrical shape because the lower part thereof is partially truncated. The ring-shaped portion 63 has an entire ring shape resembling a hoop. A rear end 62 is formed in the rear part of the cylindrical portion 61. As shown in FIGS. 1A, 2A, and 6, a plurality of slits 26 which are horizontally elongated across the ring-shaped portion 63 and the cylindrical portion 61 is formed in the right and left sides of the front cover 25.

The rear cover 11 includes a ring-shaped portion 58 resembling a hoop at the rear end. A panel 51 serving as a rear panel is formed inwardly of the cover member CV in the front side of the ring-shaped portion 58 (see FIG. 2B and FIGS. 3-5). A pair of interfaces 56 and 57 is formed in the rear face of the panel 51 (see FIG. 2B). As the interfaces 56 and 57, it is possible to use terminals, manually-operable members, and displays; but this is not a restriction. A plurality of air vents 55 is formed in the panel 51. A pair of fittings 52 is formed in the upper side of the panel 51, while a pair of fittings 53 is formed in the lower side of the panel 51. The fittings 52 and 53 are attached to the stay 20 via mounting holes (see FIGS. 2B and 5).

FIG. 6 shows a sectional view of the hook 12 having a rear element 71 and a front element 72 which are formed in parallel with each other and which are each formed in a U-shape in a side view. A tapped hole 73 which is used to receive a screw (not shown) is formed in the rear element 71 of the hook 12. All the six hooks 12 have the same structure.

Figure 7A:
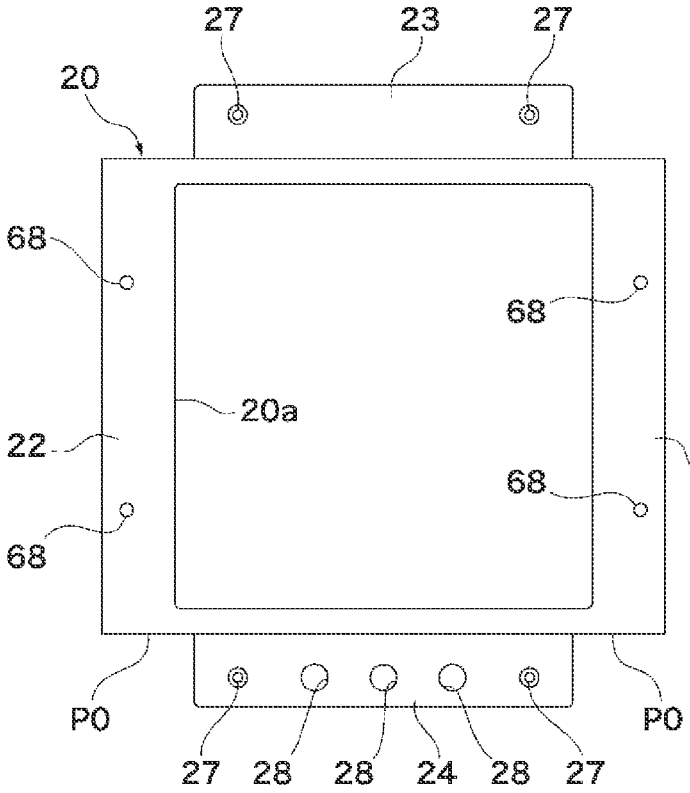
FIG. 7A is a rear view of a stay in the electronic percussion instrument.
Figure 7B:
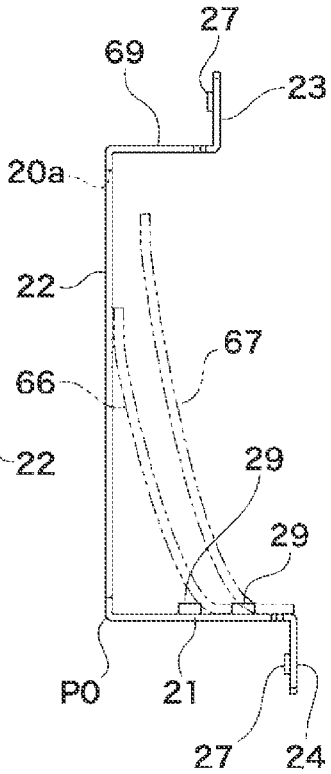
FIG. 7B is a side view of the stay in the electronic percussion instrument.
Figure 7C:
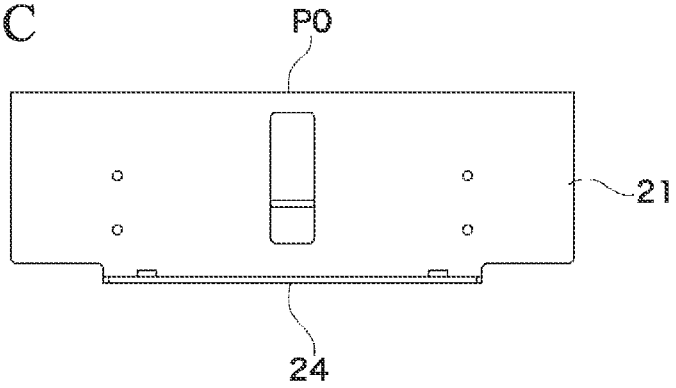
FIG. 7C is a bottom view of the stay in the electronic percussion instrument.
Figure 7D:
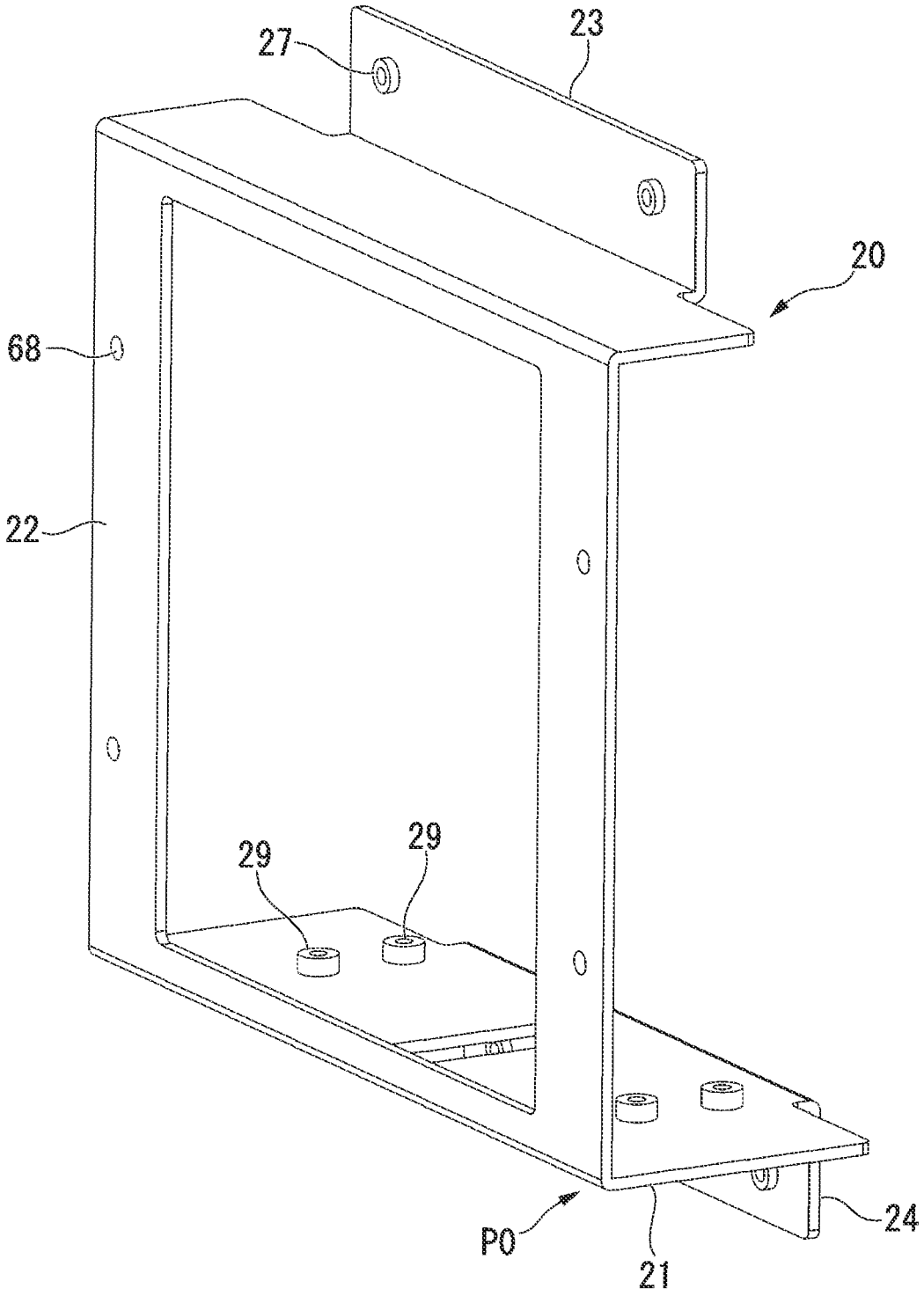
FIG. 7D is a perspective view of the stay in the electronic percussion instrument.

FIG. 7A is a rear view of the stay 20; FIG. 7B is a side view of the stay 20; FIG. 7C is a bottom view of the stay; FIG. 7D is a perspective view of the stay 20.

The stay 20 serving as a support member is formed with a sufficient rigidity which is sufficient to support the pad member PD and with flexibility which is sufficient to restore the original shape against a warp or deflection due to an external force applied to the stay 20. For example, the stay including various parts is integrally made of a metal such as an iron. The stay 20 includes a rectangular plate with a large hole 20*a*. The left and right sides of the rectangular plate encompassing the large hole 20*a* may serve as a pad-attaching portion 22. The pad-attaching portion 22 is positioned vertically when the stay 20 is attached to the stand 10 in the electronic percussion instrument.

In the stay 20, the upper and lower portions of the rectangular plate encompassing the large hole 20*a* are bent perpendicular to the pad-attaching portion 22, wherein the lower portion of the rectangular plate servers as a stand-attaching portion 21 while the upper portion of the rectangular plate serves as an upper plate portion 69. The stand-attaching portion 21 is placed horizontally. As shown in FIG. 7B, the lower portion of the rectangular plate of the stay 20 is bent in an L-shape in a side view such that the stand-attaching portion 21 and the pad-attaching portion 22 are connected together via an inflection point P0. The inflection point P0 is positioned at the front end of the stand-attaching portion 21.

An upper joining element 23 is extended upwardly from the rear end of the upper plate portion 69 while a lower joining element 24 is extended downwardly from the rear end of the stand-attaching portion 21. A pair of fastenings 27 is formed in the upper joining element 23 while a pair of fastenings 27 is formed in the lower joining element 24. The fastenings 27 have tapped holes to attach the rear cover 11 to the stay 20. Additionally, a plurality of holes 28 which is used to attach the interface 56 to the panel 51 is formed in the lower joining element 24. A plurality of fastenings 29 with tapped holes which are used to attach the stand-attaching portion 21 to the stand 10 is formed in the stand-attaching portion 21. A plurality of fastening holes 68 which is used to attach the pad member PD to the pad-attaching portion 22 is formed in the pad-attaching portion 22.

Figure 7E:
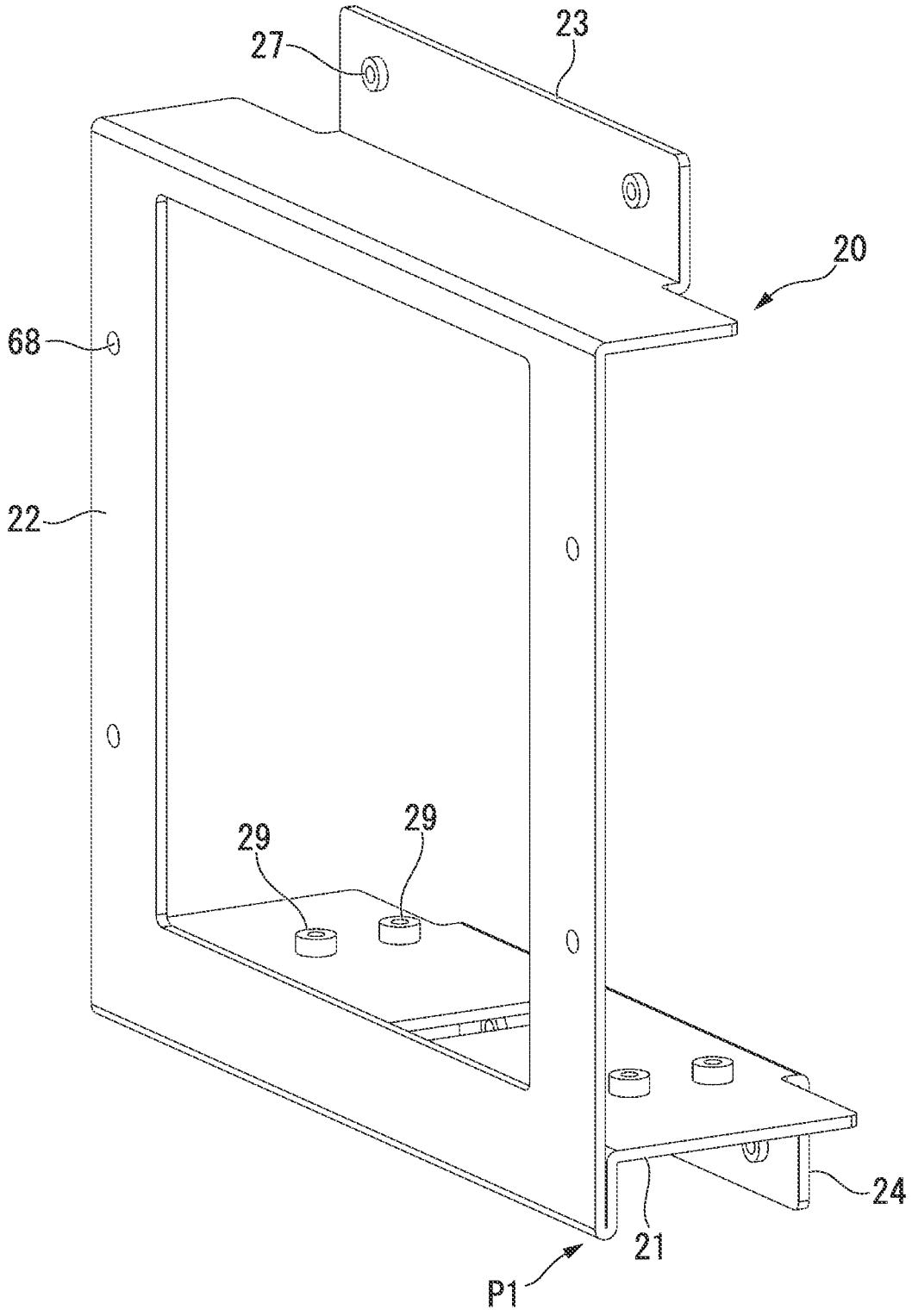
FIG. 7E is a perspective view showing a modified example of the stay in the electronic percussion instrument.

FIG. 7E shows a modified example of the stay 20 in which the lower portion of the rectangular plate is partially folded back and then horizontally bent to form the stand-attaching portion 21. Herein, an inflection point P1, which corresponds to the lower end of the folded portion of the rectangular plate of the stay 20, is positioned below the front end of the stand-attaching portion 21.

The pad member PD is attached to the stand 10 in the following manner. First, the stand-attaching portion 21 of the stay 20 is brought into contact with the front leg 13 of the stand 10, wherein screws (not shown) are screwed into the fastenings 29 so as to fix the stand-attaching portion 21 to the stand 20 (see FIGS. 1B and 5). A plurality of cushion layers 18 which is laminated in the front-rear direction is attached to the cushion-holding member 19, wherein the impact sensor 17 which is configured of a piezoelectric element is interposed between the cushion layers 18 (see FIGS. 3 and 4).

The pad-attaching portion 22 together with the flange of the cushion-holding member 19 is fixed to the rear face of the frame 40 of the pad member PD by use of screws (not shown) inserted into the fastenings 68 of the pad-attaching portion 22 of the stay 20 (see FIG. 1B). It is possible to use the frame 40, which is fixed to the stay 20 and the cushion-holding member 19, independently of the pad member PD. Alternatively, it is possible to incorporate the frame 40 into the pad member PD in advance. In this connection, it is possible to directly fix the pad-attaching portion 22 of the stay 20 to the pad member PD without using the flange of the cushion-holding member 19. Alternatively, it is possible to fix the cushion-holding member 19 to the pad member PD via another member (not shown) without using the flange of the cushion-holding member 19.

As shown in FIGS. 3 and 4, a part of the cushion layers 18 is inserted into an horizontally-elongated flame hole 41 which is formed in the frame 40 when the pad member PD is fixed to the stay 20 and the cushion-holding member 19, wherein the front face of the cushion layer 18 is brought into contact with the rear face of the head 30 (i.e. the rear face of the main strike area 38 of the head 30).

The cover member CV is fixed to the stand 10 in the following manner. First, the fittings 52 and 53 of the rear cover 11 are brought into contact with the upper and lower joining elements 23 and 24 of the stay 20 in the rearward direction, wherein screws (not shown) are inserted into the fastenings 27 via the mounting holes of the fittings 52 and 53 so as to attach the stay 20 to the rear cover 11 (see FIGS. 3 and 5).

As shown in FIG. 4, the rear end 62 of the front cover 25 is inwardly engaged with a front end 54 of the ring-shaped portion 58 of the rear cover 11 in the frontward direction. In this condition, the front cover 25 and the rear cover 11 are joined together via the six hooks 12 with the front elements 72 and the rear elements 71 in the front-rear direction, and therefore the front cover 25 is temporarily connected to the rear cover 11.

Subsequently, screws (not shown) are inserted into the tapped holes 73 of the rear elements 71 of the hooks 12 such that the distal ends of screws press the rear cover 11 in the frontward direction. As screws are deeply inserted into the tapped holes 73 of the rear elements 71 of the hooks 12, the front ends 72 of the hooks 12 press the front cover 25 in the rearward direction, thus increasing the joining force between the front elements 72 and the rear elements 71. By tightening the hooks 12 which are positioned at six positions in the circumferential direction of the pad member PD, it is possible to firmly connect the front cover 25 to the rear cover 11, thus producing the cover member CV which is integrally unified.

The hooks 12 visually resemble lugs may demonstrate advantageous effects such as good designs combined with cover-connecting functions. In this connection, it is possible to employ another method of fixing the front cover 25 to the rear cover 11, and it is possible to employ another method of fixing the hooks 12, wherein the hooks 12 are not essential to combine the front cover 25 with the rear cover 11. However, the present embodiment is advantageous in that the hooks 12 can be easily attached to or detached from the pad member PD, which makes it easy to do maintenance on the electronic percussion instrument. Additionally, it is easy for a worker to make decorations for the electronic percussion instrument by changing the hooks 12.

Owing to the fixture of the cover member CV, the external circumference of the head 30 in the periphery of the pad member PD is covered with the front cover 25, wherein the front cover 25 is solely supported by the rear cover 11 but the front cover 25 is not brought into contact with the pad member PD. The periphery 31 of the head 30 is covered with the ring-shaped portion 63 of the front cover 25 in the frontward direction, wherein the front cover 25 is not brought into contact with the head 30. That is, the pad member PD is supported by the stand 10 via the rear cover 11 and the stay 20, and therefore the front cover 25 is not used to support the pad member PD.

In the above structure, when the main strike area 38 of the head 30 is being struck with a beater, vibration occurring in the head 30 is transmitted to the impact sensor 17 via the foremost cushion layer 18. The impact sensor 17 converts vibration into an electric signal (i.e. a voltage) so as to output a detection signal. Thus, it is possible to detect an impact applied to the head 30 when the detection signal exceeds the predetermined threshold. A musical sound generating system (not shown) generates a musical sound with a volume corresponding to the detection signal at the timing to detect an impact applied to the head 30.

Next, the displacement of the pad member PD in which the head 30 is being struck with a beater will be described in detail. A pressing force is instantaneously applied to the pad-attaching portion 22 together with the pad member PD, which is attached to the pad-attaching portion 22 of the stay 20, in the rearward direction when the head 30 is being struck with a beater. The pad-attaching portion 22 of the stay 20 is deflected about the inflection point P0 in the rearward direction since the stand-attaching portion 21 of the stay 20 is fixed to the stand 20. A deflection value applied to the pad-attaching portion 22 of the stay 20 may be equivalent to a striking force applied to the head 30; hence, the pad-attaching portion 22 is restored from deflection when a striking force disappears. It is possible to absorb an impact force due to striking of the head 30 via deflection of the pad-attaching member 22. In a conventional structure which is designed without considering deflection of the pad-attaching portion 22 of the stay 20, a large impact force is transmitted to the floor F when the head 30 is being struck with a beater, thus increasing the floor-reverberation sound. Owing to deflection of the pad-attaching portion 22 of the stay 20, it is possible for the present embodiment to suppress floor reverberation, thus improving sound quality while reducing noise. Additionally, it is possible to improve the durability of the electronic percussion instrument.

In a conventional structure in which a cover resembling a shell is brought into contact with the pad member PD, a vibration occurring on the head 30 being struck with a beater is directly transmitted to the cover so as to amplify a sound, thus causing sound-box reverberation. In contrast, the present embodiment is designed to suppress sound-box reverberation since the cover member CV is not brought into contact with the pad member PD.

Similar to the pad member PD, the cover member CV is attached to the stay 20, and therefore the cover member PD will be partially displaced due to deflection of the stay 20. Due to a striking force applied to the head 30, the pad member PD is partially displaced and inclined in the rearward direction in connection with deflection of the pad-attaching portion 22 of the stay 20, and therefore the cover member CV is correspondingly displaced. In this connection, a clearance formed between the cover member CV and the pad member PD is adjusted in the initial condition of the head 30 which is not actually struck with a beater. This clearance is substantially maintained even when the head 30 is struck with a beater. Thus, it is possible to reliably suppress sound-box reverberation.

Additionally, it is possible to further suppress sound-box reverberation since the slits 26 of the front cover 25 and the air vents 55 of the rear cover 11 allow air inside the cover member CV to communicate with ambient air.

In the present embodiment, the stay 20 is designed such that the pad-attaching portion 22, which is attached to the pad member PD, is deflected in the rearward direction relative to the stand-attaching portion 21 due to a striking force applied to the head 30. Owing to deflection of the pad-attaching portion 22 of the stay 20, it is possible to absorb an impact force applied to the head 30; it is possible to improve sound quality while reducing noise by suppressing floor reverberation; and it is possible to improve durability of the electronic percussion instrument.

Additionally, it is possible to set the fulcrum of deflection occurring in the pad-attaching portion 22 of the stay 20 in the front side as possible since the inflection point P0 is positioned at the front end of the stand-attaching portion 21 of the stay 20. Thus, it is possible to prevent the stand 10 from being temporarily risen above the floor, thus improving the durability of the electronic percussion instrument.

The rear cover 11 having elasticity is fixed to the upper and lower joining elements 23 and 24, which are vertically distanced from each other and formed in the upper and lower portions of the stay 20. That is, the rear cover 11 may demonstrate an effect to reinforce the stay 20 when the pad-attaching portion 22 is elastically deflected. In other words, it is possible to elastically reinforce the pad-attaching portion 22 of the stay 20, thus improving durability of the electronic percussion instrument. The rear cover 11 provides the panel 51 which is used to arrange the interfaces 56 and 57; hence, the present embodiment may not unnecessarily increase the number of parts.

In terms of reinforcement, it is possible to arrange a reinforcing member 66 in connection with the stand-attaching portion 21 and the pad-attaching portion 22 of the stay 20 as shown by imaginary lines (i.e. dashed lines) in FIG. 7B. The reinforcing member 66 is attached to the stand-attaching portion 21 and the pad-attaching portion 22 of the stay 20 such that the stay 20 will be deflected in the predetermined direction. Alternatively, it is possible to arrange a stopper 67 inside the stay 20. Herein, one end of the stopper 67 is fixed to the stand-attaching portion 21 while the other end of the stopper 67 is positioned in the rearward direction of the pad-attaching portion 22 but slightly distanced from the pat-attaching portion 22 with a small gap. When the pad-attaching portion 22 of the stay 20 is further deflected by a deflection value larger than the predetermined threshold, the pad-attaching portion 22 comes in contact with the other end of the stopper 67, which thus demonstrate an effect to reinforce the pad-attaching portion 22 and an effect to stop the pad-attaching portion 22 while preventing the pad-attaching portion 22 from being excessively deflected. In this connection, it is possible to arrange both the reinforcing member 66 and the stopper 67.

The stay 20 is integrally molded using a metal; hence, it is possible to easily produce the stay 20 with high durability. In terms of an effect to absorb an impact force which is exerted when the head 30 is being struck with a beater, the stay 20 is not necessarily made of a metal while the stay 20 is not necessarily subjected to integral molding.

In the present embodiment, the stay 20 is designed such that the pad-attaching portion 22 and the stand-attaching portion 21 are formed in an L-shape (see FIG. 7B). In terms of an effect to absorb an impact force due to deflection of the pad-attaching portion 22 of the stay 20, it is possible to redesign the stay 20 such that the pad-attaching portion 22 and the stand-attaching portion 21 are formed in a reverse L-shape. In this case, the inflection point P0 is positioned at the rear end of the stand-attaching portion 21 while the pad-attaching portion 22 is extended upwardly from the rear end of the stand-attaching portion 21.

In the present embodiment, the cover member CV which covers the external circumference of the pad member PD is attached to the stay 20, which is fixed to the stand 10, such that the cover member CV will not come in contact with the pad member PD via a clearance. Thus, it is possible for the cover member CV covering the pad member PD to improve sound quality while reducing noise by suppressing sound-box reverberation.

Additionally, the pad member PD is not fixed to the cover member CV but is fixed to the stay 20 independently of the cover member CV. Thus, it is possible to prevent a relatively large displacement from occurring in the cover member CV and the pad member PD even when the stay 20 is displaced due to a striking force applied to the head 30. In other words, it is possible to maintain the non-contact condition between the pad member PD and the cover member CV while securing noiselessness by suppressing sound-box reverberation.

In terms of an effect to suppress sound-box reverberation via the cover member CV covering the pad member PD, the cover member PD is not necessarily fixed to the stay 20. For example, it is possible to fix the cover member CV to a part of the stand 10. Alternatively, it is possible to fix the cover member CV to a fixing part, which is fixed to the stand 10 irrespective of the pad member PD. As a fixing part which the cover member CV is fixed to, for example, it is possible to use an intermediate member such as the cushion-holding member 19 which is fixed to the stand 10.

The present embodiment requires that the pad member PD should not come in contact with the cover member CV. In this respect, the pad member PD may be directly or indirectly fixed to the foregoing fixing part. Additionally, it is possible to integrally unify the front cover 25 and the rear cover 11 as an integral cover unit. Moreover, it is possible to fix the rear cover 11 to the stand 10 on the condition that an effect to reinforce the pad-attaching part 22 is no longer required.

Figure 8:
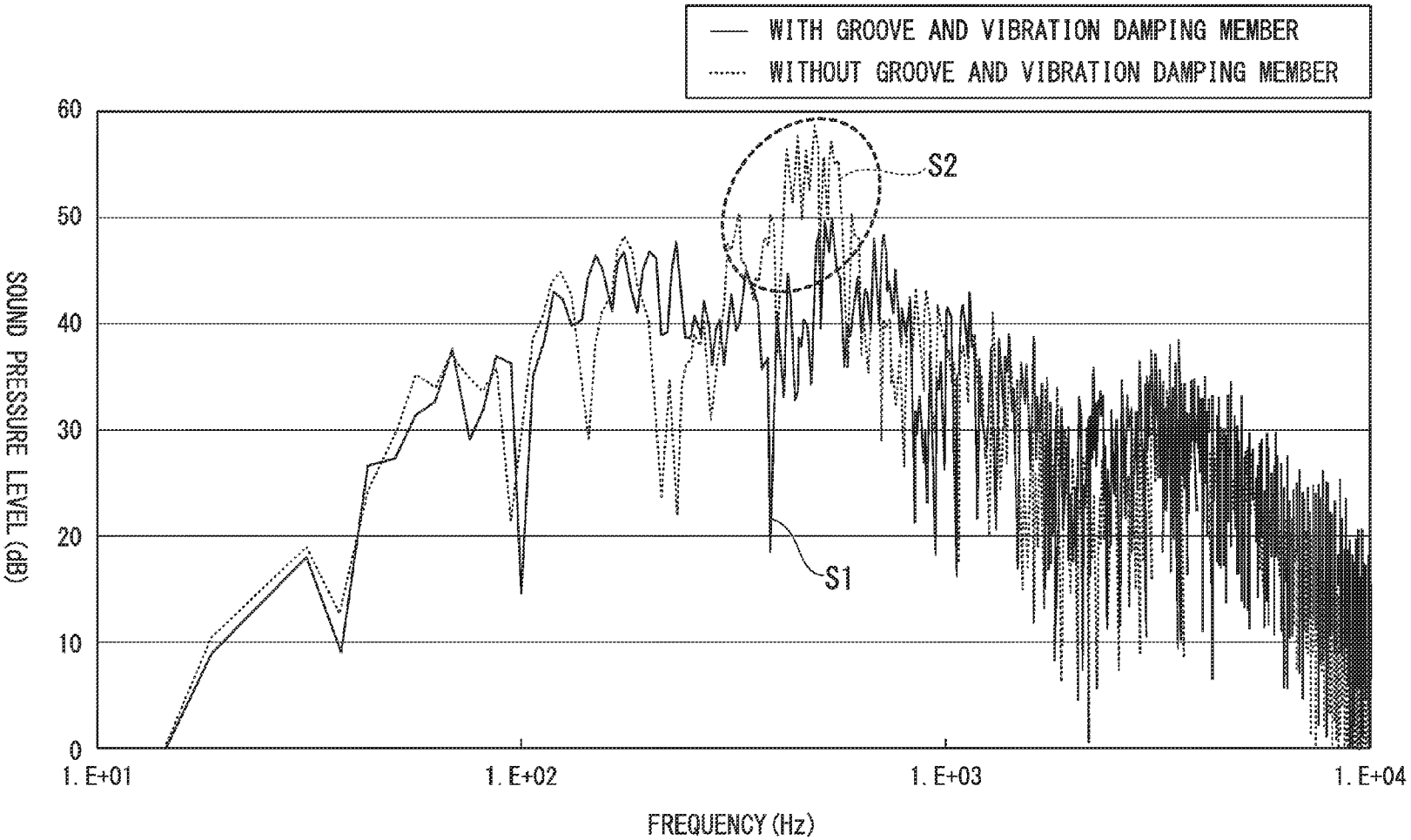
FIG. 8 is a graph showing frequency characteristics of impulsive sounds with or without a vibration-damping member and a groove in the back of the head in the electronic percussion instrument.

The present embodiment demonstrates acoustic effects in terms of frequency characteristics and noiselessness. FIG. 8 shows frequency characteristics of impulsive sounds S1, S2, wherein the impulsive sound S1 is measured with the head structure including a groove and a vibration-damping member in the back of the head, while the impulsive sound S2 is measured with the head structure precluding a groove and a vibration-damping member. As shown by a dotted circle in FIG. 8, the peak portion of the impulsive sound S1 is significantly attenuated in sound pressure in comparison of the peak portion of the impulsive sound S2. Thus, it is possible to secure noiselessness in the electronic percussion instrument.

Figure 9A:
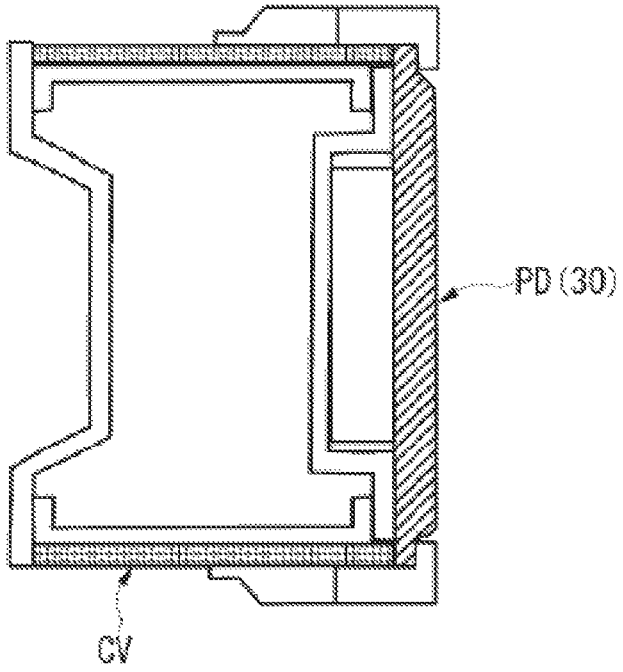
FIG. 9A (Prior Art)
FIG. 9A is a sectional view diagrammatically showing the structure of a conventionally-known electronic percussion instrument in which a shell is brought in contact with a head.
Figure 9B:
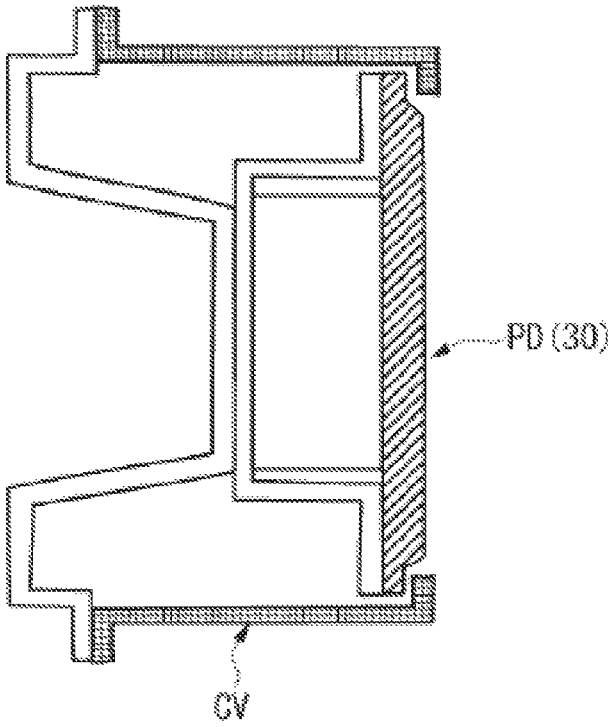
FIG. 9B is a sectional view diagrammatically showing the structure of the present invention in which a shell is not brought in contact with a head.

The technical feature of the present invention will be described with reference to FIGS. 9A and 9B. FIG. 9A shows the structure of a conventionally-known electronic percussion instrument in which a shell (corresponding to the cylindrical drum body furnished with the cover CV) is brought into contact with a head such that the external circumference of a head is entirely fixed to the external circumference of a shell without any gap therebetween. As described above, this structure may contribute to sound-box reverberations, thus degrading sound quality in an electronic percussion instrument. In contrast, the present invention is designed as shown in FIG. 9B such that a shell (i.e. the cylindrical drum body furnished with the cover CV) is not brought into contact with a head (i.e. the pad member PD and the head 30). Specifically, a clearance is formed circumferentially between the external circumference of a head and the external circumference of a shell. Noticeably, the present invention is designed to maintain an adequate clearance between the head 30 and the cover CV irrespective of an impact applied to the head 30 with a beater. This reliably reduces sound-box reverberations so as to secure noiselessness in an electronic percussion instrument.

Lastly, the present invention is not necessarily limited to the foregoing embodiment and variations, which can be further modified in various ways within the scope of the invention as defined by the appended claims. The technical features of the present invention can be summarized as follows.

(1) The electronic percussion instrument provides a kick pad device with a strike area being struck with a beater. The head of the electronic percussion instrument is coupled with the frame which is used to fix and adjust the position of a kick pedal device having a beater. Herein, the electronic percussion instrument introduces a support member (e.g. a stay) having an L-shape or a reverse L-shape in a plan view, in which a stand-attaching portion and a pad-attaching portion are connected together at an inflection point. The pad-attaching portion having sufficient rigidity is used to directly or indirectly fix a cover member which covers a head with a strike area in the electronic percussion instrument. Even when the support member is being temporarily deflected due to an impact applied to the strike area of the head, the head may be moved in correspondence with the cover member; this prevents the head from being exposed outside of the cover member, thus preventing the electronic percussion instrument from being degraded in terms of the external appearance. Owing to the interlocking mechanism in which the cover member is moved in correspondence with the head via the support member, it is possible to prevent the head from being unexpectedly brought into contact with the cover member, thus reducing noise which may occur due to a contact between the cover member and the head in the electronic percussion instrument.

(2) The L-shaped stay is made of a metal such that the pad-attaching portion and the stand-attaching portion are seamlessly connected at the inflection point without using an additional connection member having rigidity. However, it is possible to use an additional connection member made of a resin which can be temporarily deflected or warped with ease. Alternatively, it is possible to use an additional connection member made of a metal which can be temporarily deflected or warped with ease. By additionally using an elastic connection member at the inflection point of the support member, it is possible to adequately reinforce the inflection point while securing appropriate deflection or warping at the inflection point. When the support member is designed such that the connection member is visible in view of each user, it is possible for each user to feel a sense of securing adequate connection in the support member which is perpendicularly bent at an inflection point. This is because each user may not have confidence in the mechanical integrity of the electronic percussion instrument when the support member is made of an iron plate which is simply bent at an inflection point.

(3) A panel is arranged in correspondence with the pad-attaching portion of the support member which corresponds to the back of the head. This makes it possible to position the panel in proximity to the head, thus allowing the panel to be moved in correspondence with the head in the electronic percussion instrument. Thus, it is possible to prevent mechanical parts from being unexpectedly deviated in positioning, thus preventing the electronic percussion instrument from being damaged due to repeated striking of the head.

(4) Preferably, it is possible to additionally introduce a stopper which may maintain an allowable deflection value even when the L-shaped support member is being deflected due to striking of the head in the electronic percussion instrument.

What is claimed is:

1. An electronic percussion instrument comprising:

a stand disposable on a floor;

a support member including a stand-attaching portion fixed to the stand and a pad-attaching portion extending vertically from the stand-attaching portion at an inflection point, wherein the stand-attaching portion and the pad-attaching portion are unified together to form a bent profile;

a pad member, including a head with a main strike area strikable with a beater, attached to the pad-attaching portion; and an impact sensor that converts a vibration occurring on the head into an electric signal, wherein the main strike area of the head is disposed at a different level from the inflection point so that the pad-attaching portion deflects about the inflection point in a rearward direction relative to the stand-attaching portion when the main strike area of the head is struck with the beater.

2. An electronic percussion instrument comprising:

a stand disposable on a floor;

a support member including a stand-attaching portion fixed to the stand and a pad-attaching portion extending vertically from the stand-attaching portion at an inflection point, wherein the stand-attaching portion and the pad-attaching portion are unified together to have a bent profile;

a pad member, including a head strikable with a beater, attached to the pad-attaching portion; and an impact sensor that converts a vibration occurring on the head into an electric signal, wherein the support member is configured so that the pad-attaching portion deflects about the inflection point in a rearward direction relative to the stand-attaching portion when the head is struck with the beater, and wherein the inflection point is positioned at a front end of the stand-attaching portion.

3. An electronic percussion instrument comprising:

a stand disposable on a floor;

a support member including a stand-attaching portion fixed to the stand and a pad-attaching portion extending vertically from the stand-attaching portion at an inflection point, wherein the stand-attaching portion and the pad-attaching portion are unified together to have a bent profile;

a pad member, including a head strikable with a beater, attached to the pad-attaching portion;

an impact sensor that converts a vibration occurring on the head into an electric signal; and a rear panel arranged with at least one interface and fixed to either an upper portion or a lower portion in a rear side of the pad-attaching portion, wherein the support member is configured so that the pad-attaching portion deflects about the inflection point in a rearward direction relative to the stand-attaching portion when the head is struck with the beater.

4. The electronic percussion instrument according to claim 3, further comprising a front cover covering an external circumference of the pad member and attached to the rear panel without contacting the pad member.

5. The electronic percussion instrument according to claim 1, wherein the support member is an integrally piece made of metal.

6. An electronic percussion instrument comprising:

a stand disposable on a floor;

a support member including a stand-attaching portion fixed to the stand and a pad-attaching portion extending vertically from the stand-attaching portion at an inflection point, wherein the stand-attaching portion and the pad-attaching portion are unified together to have a bent profile;

a pad member, including a head strikable with a beater, attached to the pad-attaching portion;

an impact sensor that converts a vibration occurring on the head into an electric signal; and a reinforcing member fixed to the stand-attaching portion and the pad-attaching portion and is configured so that the support member deflects in a predetermined direction when the head is struck with the beater, wherein the support member is configured so that the pad-attaching portion deflects about the inflection point in a rearward direction relative to the stand-attaching portion when the head is struck with the beater.

7. An electronic percussion instrument comprising:

a stand disposable on a floor;

a support member including a stand-attaching portion fixed to the stand and a pad-attaching portion extending vertically from the stand-attaching portion at an inflection point, wherein the stand-attaching portion and the pad-attaching portion are unified together to have a bent profile;

a pad member, including a head strikable with a beater, attached to the pad-attaching portion;

an impact sensor that converts a vibration occurring on the head into an electric signal; and a stopper with one end fixed to the stand-attaching portion and another end positioned in proximity to the pad-attaching portion with a gap in a rearward direction, wherein the support member is configured so that the pad-attaching portion deflects about the inflection point in a rearward direction relative to the stand-attaching portion when the head is struck with the beater.

8. The electronic percussion instrument according to claim 1, wherein the support member has an L-shape or reverse L-shape profile, with the pad-attaching member vertically extending from a front end or a rear end of the stand-attaching portion.

9. The electronic percussion instrument according to claim 2, further comprising a rear panel arranged with at least one interface and fixed to either an upper portion or a lower portion in a rear side of the pad-attaching portion.

10. The electronic percussion instrument according to claim 2, wherein the support member is an integrally piece made of metal.

11. The electronic percussion instrument according to claim 3, wherein the support member is an integrally piece made of metal.

12. The electronic percussion instrument according to claim 4, wherein the support member is an integrally piece made of metal.

13. The electronic percussion instrument according to claim 9, wherein the support member is an integrally piece made of metal.

14. The electronic percussion instrument according to claim 7, wherein the support member is an integrally piece made of metal.

15. The electronic percussion instrument according to claim 3, wherein the support member has an L-shape or reverse L-shape profile, with the pad-attaching member vertically extending from a front end or a rear end of the stand-attaching portion.

16. The electronic percussion instrument according to claim 6, wherein the support member has an L-shape or reverse L-shape profile, with the pad-attaching member vertically extending from a front end or a rear end of the stand-attaching portion.

17. The electronic percussion instrument according to claim 7, wherein the support member has an L-shape or reverse L-shape profile, with the pad-attaching member vertically extending from a front end or a rear end of the stand-attaching portion.

* * * * *